US010337515B2

(12) United States Patent
Steffens

(10) Patent No.: US 10,337,515 B2
(45) Date of Patent: Jul. 2, 2019

(54) SPINDLE COMPRESSOR USING REFRIGERANT COOLING FOR HOUSING AND ROTOR

(71) Applicants: Ralf Steffens, Esslingen (DE); Steffen Klein, Schorndorf (DE)

(72) Inventor: Ralf Steffens, Esslingen (DE)

(73) Assignee: Steffen Klein (DE)

( * ) Notice: Subject to any disclaimer, the term of this patent is extended or adjusted under 35 U.S.C. 154(b) by 140 days.

(21) Appl. No.: 15/316,010

(22) PCT Filed: Jun. 3, 2015

(86) PCT No.: PCT/EP2015/062376

§ 371 (c)(1),
(2) Date: Dec. 2, 2016

(87) PCT Pub. No.: WO2015/185624

PCT Pub. Date: Dec. 10, 2015

(65) Prior Publication Data

US 2017/0089342 A1 Mar. 30, 2017

(30) Foreign Application Priority Data

Jun. 3, 2014 (DE) ..... 10 2014 008 288

(51) Int. Cl.
*F04C 18/54* (2006.01)
*F04C 18/56* (2006.01)
(Continued)

(52) U.S. Cl.
CPC ..... *F04C 29/04* (2013.01); *F04C 18/54* (2013.01); *F04C 18/565* (2013.01); *F04C 28/08* (2013.01); *F04C 2270/19* (2013.01)

(58) Field of Classification Search
CPC ..... F04C 18/565; F04C 18/14; F04C 18/54; F04C 29/04
See application file for complete search history.

(56) References Cited

U.S. PATENT DOCUMENTS 8,876,506 B2 * 11/2014 Steffens ..... F04C 29/04 418/194

FOREIGN PATENT DOCUMENTS

DE 19522559 A1 1/1997
DE 102012202712 A1 8/2012
(Continued)

*Primary Examiner* — Mary Davis
(74) *Attorney, Agent, or Firm* — McCarter & English, LLP

(57) ABSTRACT

The invention relates to a spindle compressor without operating fluid in the working space with a 2-tooth spindle rotor and a 3-tooth spindle rotor in a surrounding compressor housing-and preferably non-parallel rotation axes of the two spindle rotors, in particular for use in compression refrigeration machines. In order to improve the degree of efficiency while providing flexible power adjustment, it is proposed according to the invention that a multi-stage spindle compressor be used as a refrigerant compressor, whose compressor housing and whose spindle rotors are cooled via a partial-flow branch-off of liquid refrigerant from the refrigerant main flow circuit, wherein the compressor housing is cooled in a controlled manner by means of refrigerant evaporation, with the refrigerant vapor being subsequently fed to the inlet, and that, for power adjustment, there are also post-inlet feeds into the working space in addition to the inlet feed, and also pre-outlet discharges in addition to the outlet discharge from the outlet space, each with their own regulating device.

12 Claims, 3 Drawing Sheets

(51) Int. Cl.
*F04C 28/08* (2006.01)
*F04C 29/04* (2006.01)

(56) References Cited

FOREIGN PATENT DOCUMENTS

DE 102011004960 A1 9/2012
DE 102012011820 A1 12/2013

* cited by examiner

SPINDLE COMPRESSOR USING REFRIGERANT COOLING FOR HOUSING AND ROTOR

CROSS-REFERENCE TO RELATED APPLICATIONS

This application is a national stage application of international application no. PCT/EP2015/062376 filed Jun. 3, 2015 entitled "Compression Refrigeration Machine Having a Spindle Compressor," claiming benefit under 35 U.S.C. § 119(a)-(d) of German application no. 10 2014 008 288.1 filed Jun. 3, 2014, which are hereby expressly incorporated by reference as part of the present disclosure.

BACKGROUND

Dry-compressing compressors are becoming ever more important in industrial compressor technology, because due to increasing obligations with regard to envonmental regulations and rising operating and disposal costs, as well as greater requirements with regard to the purity of the delivery medium, the known wet-running compressors, such as liquid ring machines, rotary vane pumps and oil or water-injected screw compressors, are replaced with dry-compressing machines with increasing frequency. Dry screw compressors, claw pumps, diaphragm pumps, piston pumps, scroll machines as well as Roots pumps are among these dry-compressing machines. However, what these machines have in common is that they still do not meet today's requirements with regard to reliability and ruggedness as well as constructional size and weight with a low price level and satisfactory efficiency at the same time.

The known dry-compressing spindle compressors are an option for improving this situation, because as typical 2-shaft displacement machines, they realize a high compression capacity simply by achieving the required multi-stage property as so-called "delivery threads" by a serial arrangement of several closed working chambers through the number of wraps per compressor rotor in an extremely uncomplicated manner, without, however, requiring an operating fluid in the working space. Moreover, the contactless rolling of the two counter-directionally rotating spindle rotors enables an increased rotational speed of the rotors, so that the nominal suction capacity and the volumetric efficiency are increased at the same time, relative to the constructional size. In this case, dry-compressing spindle machines can be used for application both in a vacuum as well as in overpressure conditions, with the power requirements in overpressure conditions of course being significantly higher because, in the overpressure range with final pressures significantly greater than 2 bar (absolute) to up to 15 bar and more, greater pressure differences have to be overcome.

For a dry-compressing spindle compressor, German patent application no. DE 10 2013 009 040.7 describes how a large internal compression ratio as well as a high number of stages is obtained with non-parallel rotation axes of the two spindle rotors, while at the same time minimizing the internal leakage between the multiple series-connected working chambers between the delivery gas inlet and the outlet. In the case of compression refrigeration machines, compressor technology for this power range is still dominated by screw compressors that require an operating fluid in the working space, with the desired power adjustment most frequently taking place by means of complex control slide valves. Moreover, 2 series-connected compressors are frequently required for higher network working pressures, and the degree of efficiency is only moderately satisfactory.

SUMMARY

This situation is to be improved.

The object of the present invention is to operate the refrigerant compressor for a compression refrigeration machine without operating fluid in the working space with an improved degree of efficiency, with, at the same time, an increased reliability also for high network working pressures, with only one compressor machine, and with a highly flexible and simple power adjustment at the same time, as well as with an at least partially hermetically sealed design and as little noise as possible at the same time.

According to the invention, this object is achieved by the refrigerant compressor being configured as a multi-stage spindle compressor machine 1 which, with preferably non-parallel rotation axes, transports the gaseous refrigerant without operating fluid in the working space from the inlet 10 to the outlet collecting space 13 and compresses it, wherein the spindle rotors 2 and 3, as well as the surrounding compressor housing 8, are in each case cooled so specifically, by means of separate refrigerant evaporators 6 and 7 and by respective regulating devices 16, 17, 18.1 or 18.2, 21, 22, 23 with respect to the pressure level and the flow rate, through a partial-flow branch-off 25 of liquid refrigerant, that the clearance distances between the spindle rotors 2, 3 and to the compressor housing 8 are maintained unchanged within desired limits for all operating states, wherein the level of the network working pressures is realized through the configured number of stages as a series connection of working chambers between the 2-toothed rotor 2 and the 3-toothed rotor 3 in the compressor working space between the inlet 10 and the outlet 13, and the adjustment of the compressor power, which is highly flexible in accordance with the requirements, is achieved by there being, in the longitudinal rotor axis direction, also post-inlet feeds 12 into the working space in addition to the inlet feed 11 to the inlet 10, and also pre-outlet discharges 15 in addition to the outlet discharge 14 from the outlet collecting space 13, wherein both the inlet feeds 11, 12 and the outlet discharges 14, 15 are each provided with their own regulating device, so that the actually conveyed refrigerant becomes specifically adjustable both with regard to the volume flow and the pressure increase for the power adjustment for the respective operating state, specifically by means of any combination, including the consequential partial flow amounts of the individual inlet feeds 11, 12 and outlet discharge 14, 15, wherein, in addition, the injection of liquid refrigerant with a separate regulating device for power adjustment is also optionally proposed, as well as the option of driving the drive motor of the spindle compressor with a frequency converter 38 in order to vary the rotary speed for the purpose of a specific power adjustment; furthermore, for applications in which the properties of the refrigerant 39 and/or the heat transfer amounts 32 or 33 to the respective rotor interior cooling system are insufficient for evaporating the refrigerant, it is proposed according to the invention that in that case, the respective rotor interior cooling system 6 or 7 is configured as a heat exchanger in accordance with DE 10 2013 009 040.7 for the liquid refrigerant, wherein this liquid refrigerant is then conveyed away for each spindle rotor by means of, for example, a pitot tube pump in accordance with DE 10 2013 009 040.7 and is then, according to the invention and in a novel manner, routed to the evaporator cooling system 9 for the compressor housing, wherein, application-specific, also mixed forms of a heat exchanger and an evaporator are possible for the rotor cooling systems 6 and 7; in addition, it is also proposed, according to the invention, that the inner rotor bore surface for rotor interior cooling is configured in such a way that parking recesses 34 and overflow ramps 35 are provided for an improved heat transfer, which are configured with different sizes corresponding to the respective heat transfer conditions in the longitudinal rotor axis direction, and that the surfaces of the rotor interior bores wetted by the refrigerant are roughened, in the sense of "non-smooth", grooved and furrowed, and can also configured in a thread-like manner.

Compared with the prior art with respect to compressors in compression refrigeration machines, the above-mentioned features of the invention achieve a sudden progress through the following inventive advantages:

1) In this manner, the degree of efficiency of the compressor is improved by means of the efficient heat dissipation during the multi-stage compression.

2) The efficient heat dissipation during compression is achieved by using the refrigerant, which is present anyway, so that no separate refrigerating devices are required for the compressor machine.

3) Moreover, the spindle compressor works without its own operating fluid in the working space, which is a significant improvement over the prior art, because an oil is required as an operating fluid in the working space in comparable screw compressors.

4) At the same time, the spindle compressor achieves the desired compression values due to its multi-stage design in only a single machine, so that, compared with the prior art, higher pressure values no longer require two compressor machines as was the case until now.

5) At the same time, the reliability and life span of the compressor is improved, because the bearing load in the spindle compressor is smaller due to the smaller radial and axial forces, with immediate positive effects on the bearing with regard to the reliability and the life span, and thus on the compressor, and consequently on the entire compression refrigeration machine.

6) For the desired power adjustment, the previous complicated and critical control slide valves can be omitted, because according to the design, virtually any volume flow and any pressure stage can be implemented with the spindle compressor according to the invention via the post-inlet and the pre-outlet.

7) Due to its proposed configuration, the spindle compressor can be directly realized as a hermetically sealed machine and, thermodynamically, is always on the safe side.

8) Due to the high number of multiple stages, the pressure pulsations at the outlet are very much smaller than in today's screw compressors, so that the spindle compressor is significantly quieter.

DETAILED DESCRIPTION OF EMBODIMENTS

Figure 1:
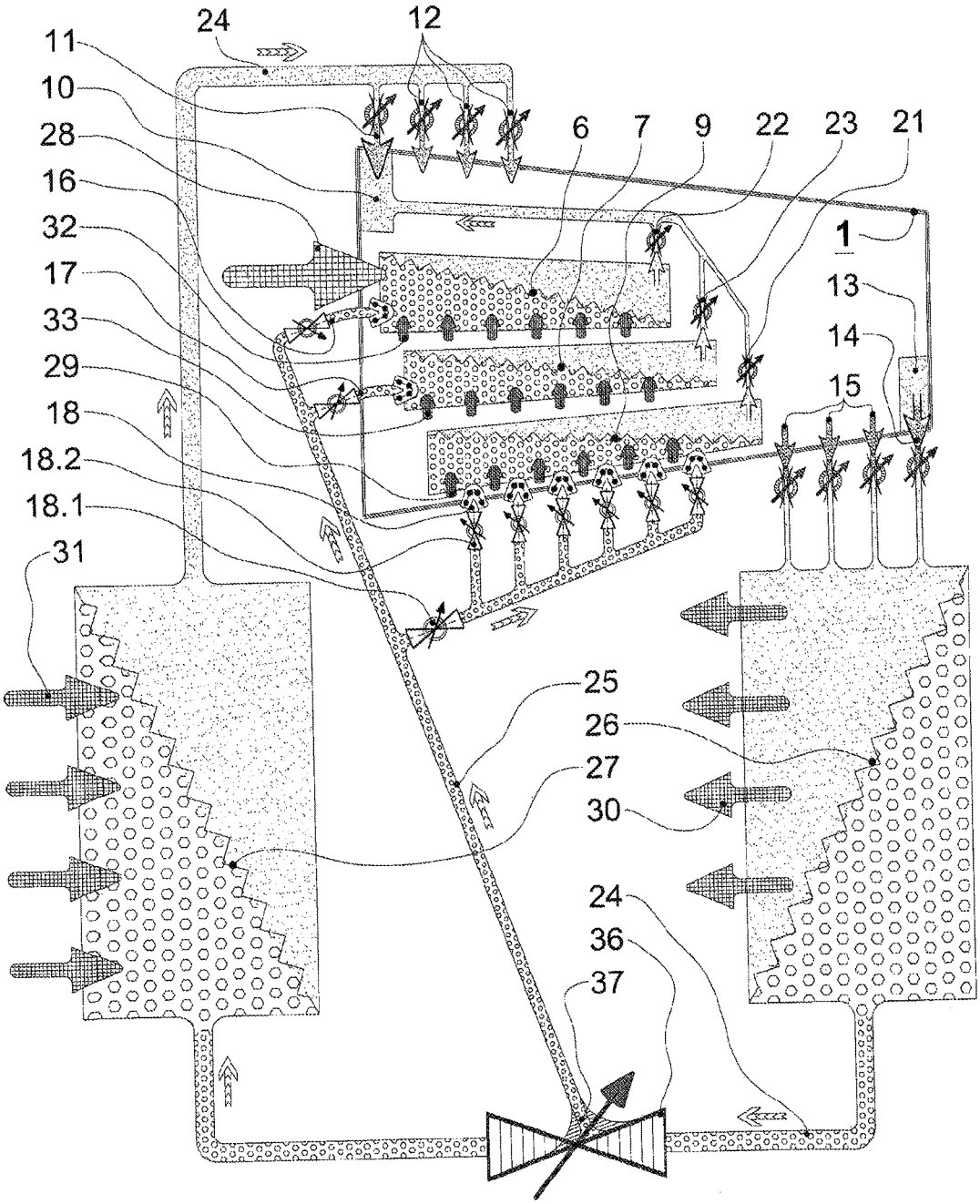
FIG. 1 schematically shows a refrigerant circuit of a compression refrigerqation machine.

The present invention is explained in more detail by means of the following illustrations:

FIG. 1 shows, by way of example for the present invention, the schematic illustration regarding the refrigerant circuit of a compression refrigeration machine with the spindle compressor as a working machine. In this case, the flow direction of the refrigerant including the various aggregate states is drawn in. The branch-off of liquid refrigerant according to the invention for the efficient cooling of the compressor components, i.e. the spindle rotor pair and the compressor housing, is also easily recognizable. Furthermore, various post-inlet feeds 12 and pre-outlet discharges 15 for the desired power adjustment are shown, which, according to the design, make virtually any desired volume flow and pressure value possible by any combination also with the inlet feed 11 and the outlet discharge 14 through the respective regulating devices.

The spindle compressor machine 1 is shown only schematically, with its construction being shown by way of example in the following representation of FIG. 2.

Figure 2:
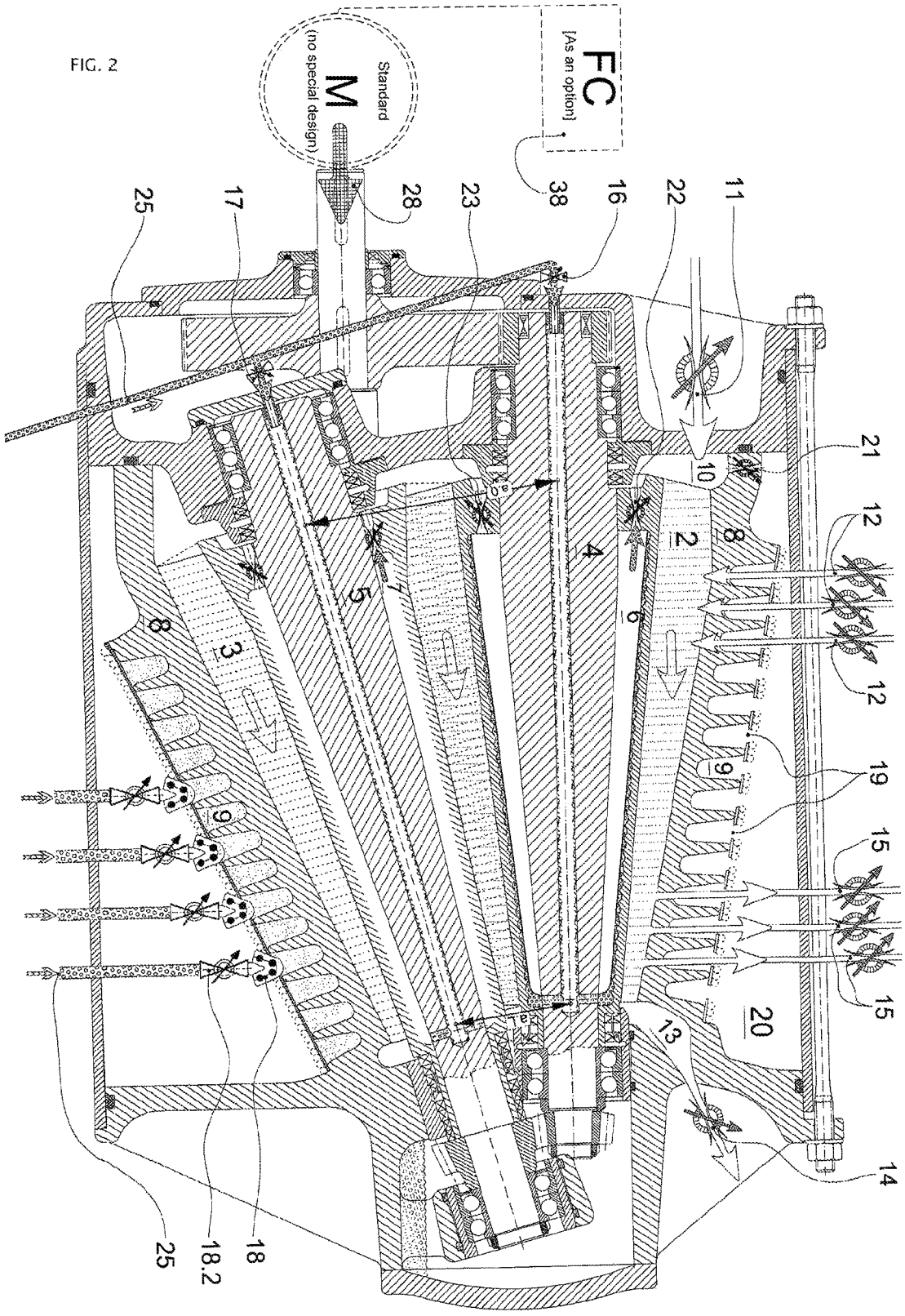
FIG. 2 schematically shows a sectional view of a spindle compressor machine of the compression refrigeration machine shown in FIG. 1.

FIG. 2 shows, by way of example for the present invention, a sectional view through the spindle compressor machine as a core element in the circuit of the compression refrigeration machine as shown in FIG. 1. The previous explanations are already so informative that any repetition would in this case doubtless be unnecessary.

Figure 3:
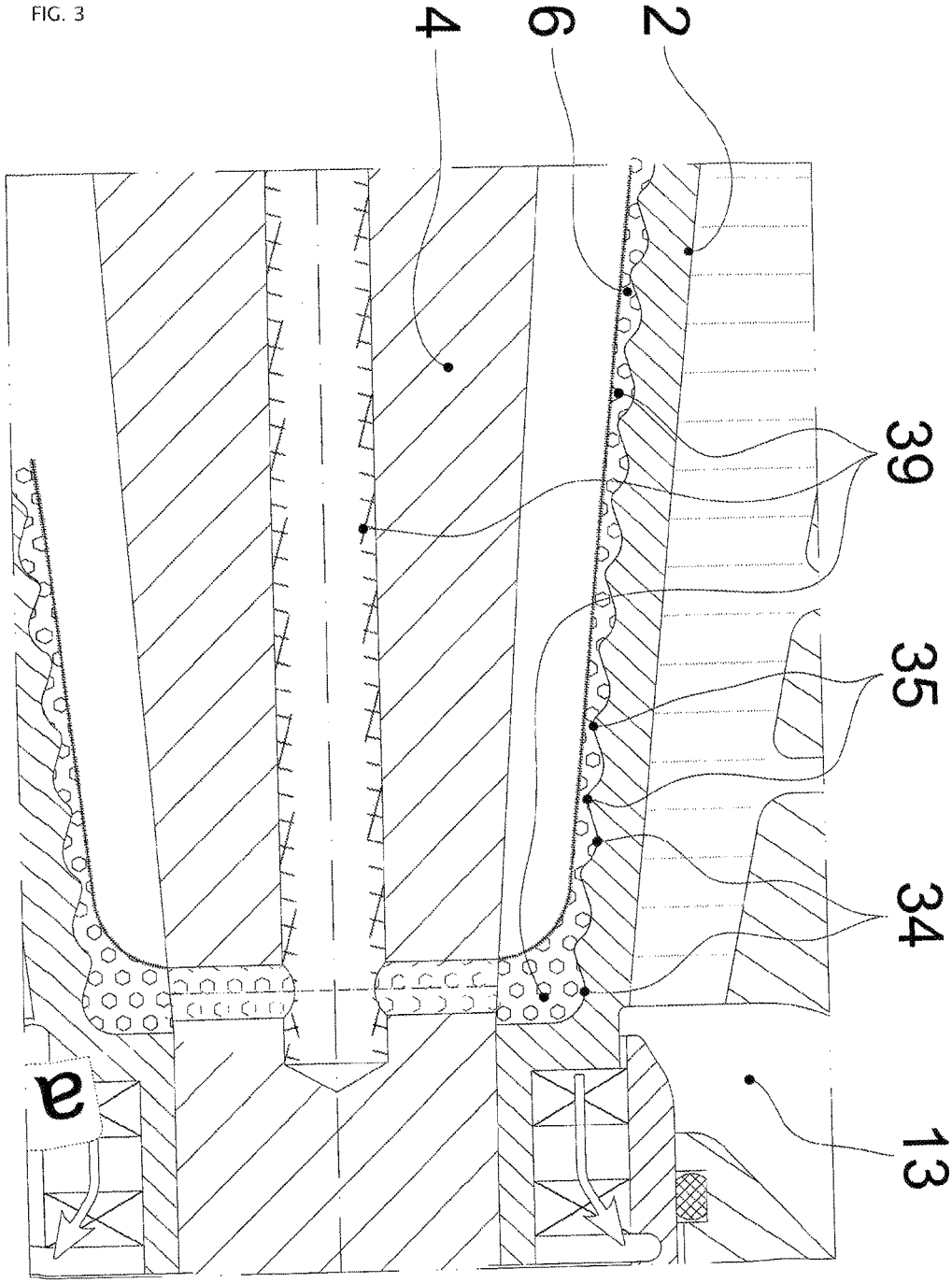
FIG. 3 schematically shows a sectional view of a interior rotor cooling configuration.

By way of example for the present invention, FIG. 3 shows an enlarged representation of a detailed configuration of the rotor interior cooling by means of the refrigerant with respect to a possible design of the above-mentioned parking recesses 34 and the overflow ramps 35, which are to be configured in such a way that, on the one hand, the heat transfer to the refrigerant takes place in an optimum manner and, on the other hand, an efficient distribution of the refrigerant in the longitudinal rotor axis direction within the cooling bore surface is achieved. Furthermore, the heat transfer to the refrigerant is significantly influenced by the configuration of this cooling bore surface, which in this case is shown by way of example as a saw-toothed line in order to present the surfaces of the rotor interior bores wetted by the refrigerant as roughened, in the sense of "non-smooth", grooved and furrowed, also in the form of an internal thread, for example.

The spindle compressor operating without operating fluid in the working space comprises a 2-tooth spindle rotor 2 and a 3-tooth spindle rotor 3 in a surrounding compressor housing 8 and preferably non parallel rotation axes of the two spindle rotors, in particular for use in compression refrigeration machines. In order to improve the degree of efficiency while providing flexible power adjustment, it is proposed according to the invention that a multi-stage spindle compressor 1 be used as a refrigerant compressor, whose compressor housing 8 and whose spindle rotors 2, 3 are cooled via a partial-flow branch-off 25 of liquid refrigerant 39 from the refrigerant main flow circuit 24, wherein the compressor housing 8 is cooled in a controlled manner by means of refrigerant evaporation 9, with the refrigerant vapor being subsequently fed to the inlet 10, and that, for power adjustment, there are also post-inlet feeds 12 into the working space in addition to the inlet feed 11, and also pre-outlet discharges 15 in addition to the outlet discharge 14 from the outlet space 13, each with their own regulating device.

In one embodiment, the compression refrigeration machine has a refrigerant main flow circuit 24 in which refrigerant 39 is located and a spindle compressor configured as a 2-shaft rotation compressor machine, which operates without operating fluid in the working space, for conveying and compressing gaseous delivery media, the spindle compressor having a 2-tooth spindle rotor 2, a 3-tooth spindle rotor 3 and a compressor housing 8 which surrounds the spindle rotors 2, 3 and has an inlet space 10 and an outlet collecting space 13, wherein the spindle compressor 1 is a multi-stage spindle compressor 1, the refrigerant main flow circuit 24 has a partial-flow branch-off 25, and the compressor housing 8 and the spindle rotors 2, 3 are cooled via the partial-flow branch-off 25 with liquid refrigerant 39 from the refrigerant main flow circuit 24.

In another embodiment, the compression heat is dissipated from the compressor housing 8 by means of refrigerant evaporation 9, wherein liquid refrigerant is routed by means of the partial-flow branch-off 25 via a regulating device 18 to a housing refrigerant evaporation system 9 and the refrigerant vapor escaping from the refrigerant evaporation system 9 via the openings 19 arrives in a collecting space 20, and that this refrigerant vapor then flows through a passageway 21 in which the regulating device 18 is located into the inlet space 10 of the spindle compressor machine 1.

In another embodiment the spindle rotors 2, 3 each have a large cooling bore, that the compression heat is dissipated from the spindle rotors 2, 3 in each case in their cooling bores by means of refrigerant evaporation 6, 7 if, under the spindle rotor conditions (such as diameter and rotary speed), the properties of the selected refrigerant and the heat transfer amounts 32, 33 are sufficient for an evaporation of the respectively supplied refrigerant, wherein liquid refrigerant is specifically routed, by means of the partial-flow branch-off 25 and in each case by means of the regulating device 16, 17, into each spindle rotor cooling bore for the respective rotor refrigerant evaporation 6, 7, and the refrigerant vapor escaping via the respective openings 22, 23 with a regulating device 18 from the respective spindle rotor refrigerant evaporation 6, 7 is routed into the inlet space 10.

In one embodiment, the rotation axes of the two spindle rotors 2, 3 extend in a non-parallel manner.

In another embodiment, the compression heat is dissipated from the spindle rotors 2, 3 in each case in their large cooling bores via liquid refrigerant as a known heat exchanger as described in DE 2013 009 040 if, under the spindle rotor conditions (such as diameter and rotary speed), the properties of the selected refrigerant and the heat transfer amounts 32, 33 are insufficient for an evaporation, wherein this liquid refrigerant is then conveyed away for each spindle rotor by means of, for example, a pitot tube pump in accordance with DE 10 2013 009 040 and is then, according to the invention and in a novel manner, routed to the evaporator cooling system 9 for the compressor housing, where it then also arrives as described above in the inlet space 10 of the spindle compressor machine 1.

In yet another embodiment, the cooling systems 6, 7, 9 described above for the spindle compressor components 2, 3, 8 are in each case used specifically, by means of the respective regulating devices 16, 17, 18.1, 18.2, 21, 22, 23 with respect to the pressure level and the flow rate, that the clearance distances between the spindle rotors 2, 3 and to the compressor housing 8 are maintained unchanged within desired limits for all operating states.

In another embodiment, there are, in the longitudinal rotor axis direction, post-inlet feeds 12 into the working space in addition to the inlet feed 11 to the inlet space 10, and also pre-outlet discharges 15 in addition to the outlet discharge 14 from the outlet collecting space 13, wherein both the inlet feeds 11, 12 and the outlet discharges 14, 15 are each provided with their own regulating device, so that the actually conveyed refrigerant becomes specifically adjustable both with regard to the volume flow and the pressure increase for the power adjustment to the respective operating state, specifically by means of any combination, including the consequential partial flow amounts of the individual inlet feeds 11, 12 and outlet discharges 14, 15.

In another embodiment, the specific power adjustment to different operating states by means of a regulating device, the injection of liquid refrigerant into the working space is also provided, and/or the option of driving the drive motor of the spindle compressor with a frequency converter 38 in order to vary the rotary speed for the purpose of a specific power adjustment.

In another embodiment, the inner spindle rotor bore surface for rotor interior cooling is configured in such a way that parking recesses 34 and overflow ramps 35 are provided for an improved heat transfer, which are configured with different sizes corresponding to the respective heat transfer conditions in the longitudinal rotor axis direction in order to ensure both the respectively suitable retention time of the refrigerant for heat absorption and the comprehensive distribution of the refrigerant on the entire cooling bore surface.

In another embodiment, the surfaces of the rotor interior bores wetted by the refrigerant are roughened, in the sense of "non-smooth", grooved and furrowed, also configured in a thread-like manner, for increasing the heat transfer surface wetted by the refrigerant and for specifically manipulating the flow movement of the refrigerant.

1. Multi-stage spindle compressor machine with preferably non-parallel spindle rotor rotation axes

2. 2-tooth spindle rotor

3. 3-tooth spindle rotor

4. Support shaft for the 2-tooth spindle rotor (2) with bilateral spindle rotor bearing, working space shaft seal, cooling fluid feed and synchronization gear wheel

5. Support shaft for the 3-tooth spindle rotor (3) with bilateral spindle rotor bearing, working space shaft seal, cooling fluid feed and synchronization gear wheel

6. Rotor interior cooling system for the 2-tooth spindle rotor (2), preferably as a refrigerant evaporator if, under the spindle rotor conditions (such as diameter and rotary speed), the properties of the selected refrigerant and the heat transfer amounts (32) are sufficient for an evaporation of the refrigerant in the cooling bore of the 2-tooth spindle rotor (2), otherwise, the rotor interior cooling system (6) for the 2-tooth spindle rotor (2) is configured as a heat exchanger in accordance with DE 10 2013 009 040.7, or, application-specific, also as a mixed form of an evaporator and a heat exchanger at the same time

7. Rotor interior cooling system for the 3-tooth spindle rotor (3), preferably as a refrigerant evaporator if, under the spindle rotor conditions (such as diameter and rotary speed), the properties of the selected refrigerant and the heat transfer amounts (33) are sufficient for an evaporation of the refrigerant in the cooling bore of the 3-tooth spindle rotor (3), otherwise, the rotor interior cooling system (7) for the 3-tooth spindle rotor (3) is configured as a heat exchanger in accordance with DE 10 2013 009 040.7, or, application-specific, also as a mixed form of an evaporator and a heat exchanger at the same time

8. Compressor housing with an encapsulating sheet-metal jacket, similar to DE 10 2012 011 823.6

9. Refrigerant evaporator cooling system for the preferably ribbed surface of the compressor housing

10. Inlet collecting space of the spindle compressor for the gaseous refrigerant

11. Inlet feed with a regulating device for the gaseous refrigerant

12. Post-inlet feeds with respective regulating devices for the gaseous refrigerant
13. Outlet collecting space of the spindle compressor for the gaseous refrigerant
14. Outlet discharge with a regulating device for the gaseous refrigerant
15. Pre-outlet discharges with respective regulating devices for the gaseous refrigerant
16. Liquid refrigerant feed to the 2-tooth rotor interior evaporator cooling system with a regulating device
17. Liquid refrigerant feed to the 3-tooth rotor interior evaporator cooling system with a regulating device
18. Liquid refrigerant feeds to the compressor housing evaporator cooling system with
    18.1 a central regulating device for smaller refrigerant spindle compressors
    18.2 in each case individual, separate regulating devices for large refrigerant spindle compressors
19. Evaporator openings in the sheet-metal jacket encapsulating the compressor housing for the compressor housing evaporator cooling system (9)
20. Collecting space that is hermetically sealed towards the outside for the evaporated housing refrigerant
21. First passageway with a regulating device for passing on the housing refrigerant vapor
22. Second passageway with a regulating device for passing on the 2-tooth rotor interior refrigerant vapor
23. Third passageway with a regulating device for passing on the 3-tooth rotor interior refrigerant vapor
24. Main flow circuit for the refrigerant, with an illustration of the flow direction
25. Branched-off partial flow of liquid refrigerant for cooling the spindle compressor
26. Condenser for the refrigerant in the main flow circuit
27. Evaporator for the refrigerant in the main flow circuit
28. Drive power for the spindle compressor
29. Heat transfer to the housing cooling system (9)
30. Heat dissipation in the refrigerant condenser (26)
31. Heat absorption in the refrigerant evaporator (27)
32. Heat transfer to the 2-tooth rotor interior cooling system (6)
33. Heat transfer to the 3-tooth rotor interior cooling system (7)
34. Parking recesses for the liquid refrigerant for rotor interior cooling
35. Overflow ramps between the parking recesses (34) for rotor interior cooling
36. Expansion valve as a throttle for the liquid refrigerant in the main flow circuit
37. Branch-off for the liquid refrigerant for cooling the spindle compressor components
38. Frequency converter for the drive motor
39. Refrigerant constantly passing through 2 states of aggregation in the refrigerant circuit
    as a liquid refrigerant (depicted with hexagonal hatching, as closed hexagonal rings)
    as a gaseous refrigerant (depicted with dotted hatching)

The invention claimed is:

1. A compression refrigeration machine comprising a refrigerant main flow circuit, refrigerant located in the refrigerant main flow circuit, and a dry-compressing spindle compressor for conveying and compressing gaseous refrigerant, the spindle compressor having a working space and being configured as a 2-shaft rotation compressor machine having a 2-tooth spindle rotor, a 3-tooth spindle rotor and a compressor housing which surrounds the spindle rotors and has an inlet space and a housing collecting space, wherein the spindle compressor is a multi-stage spindle compressor, the refrigerant main flow circuit has a partial-flow branch-off, and the compressor housing and the 2-tooth spindle rotor and the 3-tooth spindle rotor are cooled via the partial-flow branch-off with liquid refrigerant from the refrigerant main flow circuit.

2. The compression refrigeration machine according to claim 1, wherein compression heat is dissipated from the compressor housing by refrigerant evaporation, wherein liquid refrigerant is routed via the partial-flow branch-off via a first regulator to a housing refrigerant evaporation system and the gaseous refrigerant escaping from the housing refrigerant evaporation system is routed to a vapor refrigerant collecting space, and the gaseous refrigerant flows from the vapor refrigerant collecting space through a second regulator in a first passageway and into the inlet space.

3. The compression refrigeration machine according to claim 2, wherein the rotation axes of the 2-tooth spindle rotor and the 3-tooth spindle rotor extend in a non-parallel manner.

4. The compression refrigeration machine according to claim 1, wherein the 2-tooth spindle rotor and the 3-tooth spindle rotor each have a cooling bore, and compression heat is dissipated from the 2-tooth spindle rotor and the 3-tooth spindle rotor through their respective cooling bore by refrigerant evaporation.

5. The compression refrigeration machine according to claim 1, wherein the rotation axes of the 2-tooth spindle rotor and the 3-tooth spindle rotor extend in a non-parallel manner.

6. The compression refrigeration machine according to claim 1, wherein unevaporated liquid refrigerant is conveyed away from each of the 2-tooth spindle rotor and the 3-tooth spindle rotor and is routed to an evaporator cooling system for the compressor housing.

7. The compression refrigeration machine according to claim 1, wherein the clearance distances between the 2-tooth spindle rotor and the 3-tooth spindle rotor and the compressor housing are maintained unchanged within pre-selected limits for all operating states.

8. The compression refrigeration machine according to claim 1, wherein at least one inlet feed to the inlet space is provided, and there are provided, in the longitudinal rotor axis direction, post-inlet feeds into the working space and wherein at least one outlet discharge extending from the housing outlet collecting space is provided, and pre-outlet discharges are provided in addition to the outlet discharge, wherein both the inlet feed and the outlet discharge are each provided with a regulator.

9. The compression refrigeration machine according to claim 1, further including a regulator for the injection of liquid refrigerant into the working space.

10. The compression refrigeration machine according to claim 1, wherein an inner surface of the 2-tooth spindle rotor and the 3-tooth spindle rotor includes parking recesses and overflow for improved heat transfer.

11. The compression refrigeration machine according to claim 1, wherein inner surfaces of the 2-tooth spindle rotor and the 3-tooth spindle rotor wetted by the refrigerant are one or more of roughened, grooved or furrowed, or configured in a thread-like manner.

12. The compression refrigeration machine according to claim 1, wherein a frequency converter is provided for driving a drive motor of the spindle compressor, and the rotary speed of the drive motor may be varied for the purpose of power adjustment.

* * * * *